US005538022A

United States Patent [19]

Bennett

[11] Patent Number: 5,538,022

[45] Date of Patent: Jul. 23, 1996

[54] SINGLE-USE TESTER FOR COSMETIC PRODUCTS

[75] Inventor: Harold E. Bennett, Wyckoff, N.J.

[73] Assignee: Estee Lauder Companies, New York, N.Y.

[21] Appl. No.: 421,636

[22] Filed: Apr. 13, 1995

[51] Int. Cl.[6] ..... A45D 40/24; A45D 33/00

[52] U.S. Cl. ..... 132/318; 132/317; 132/320; 132/200; 401/130; 401/207

[58] Field of Search ..... 132/317, 318, 132/320, 200; 401/173, 55, 75, 49, 59, 180, 126, 130, 265, 207

[56] References Cited

U.S. PATENT DOCUMENTS

| | | | |
|---|---|---|---|
| 1,863,106 | 6/1932 | Gimonet | 401/207 |
| 2,374,065 | 4/1945 | Worthington | 132/320 |
| 2,545,444 | 3/1951 | Braselton | 132/320 |
| 3,951,157 | 4/1976 | Idec | 401/130 |
| 4,568,214 | 2/1986 | Abe et al. | 401/207 |
| 4,880,326 | 11/1989 | Spivey | 401/130 |
| 5,221,153 | 6/1993 | Spatz | 401/49 |

*Primary Examiner*—Nicholas D. Lucchesi
*Assistant Examiner*—Pedro Philogene
*Attorney, Agent, or Firm*—Pennie & Edmonds

[57] ABSTRACT

The present invention provides a disposable applicator for sampling cosmetics including lipsticks at the retail counters. Also provided are methods for extracting or otherwise transferring the cosmetics onto the applicator and sampling the cosmetics.

24 Claims, 3 Drawing Sheets

SINGLE-USE TESTER FOR COSMETIC PRODUCTS

BACKGROUND OF THE INVENTION

The present invention relates to a disposable applicator, which allows the consumers to sample cosmetic products such as lipsticks, liquid makeups, eye shadows and other types of viscous cosmetics as well as non-cosmetic products such as crayons, prior to making a purchase.

Cosmetic retailers do not normally provide "trial-size" samples at the counter. Consequently, when a consumer wishes to sample cosmetic products, the retailers usually offer her full-size items that have been previously sampled by other customers. Due to hygienic reasons the consumer may not want to apply the previously used cosmetics directly on herself. In the case of lipsticks, the consumer usually applies the lipstick to her hand and tries to imagine how the sample would look on her lips.

Also, consumer protection and health regulations have been enacted in at least one state which ban shared testers and require retailers and cosmetic companies to provide customers with disposable makeup applicators or samples, or post warning signs and safety instructions.

In response, manufacturers have introduced cosmetic samples to be provided to customers in encapsulated blisters. For lipsticks, customers may apply this type of samples to their lips with cotton swabs. This is a less satisfactory solution. At the present time, there is no disposable applicator that allows the consumers to extract lipstick at the retail counters.

Other types of applicators are known, e.g., U.S. Pat. No. 5,301,697 to Gueret discloses a disposable applicator having the cosmetics pre-applied to it at the factory under high temperature and pressure conditions; U.S. Pat. No. 5,040,914 to Fitjer discloses a permanent plastic applicator that is porous and sponge-like; U.S. Pat. No. 4,955,745 also discloses a soft porous applicator for applying nail polish; and U.S. Pat. No. 4,050,826 discloses a permanent applicator that allows viscous fluid to pass through via capillary action.

Thus, there remains an unresolved need in the cosmetic industry for a disposable applicator which is capable of extracting an amount of cosmetics, e.g., lipsticks, sufficient for a single use. Additionally, the applicator would be stored "dry", i.e., without cosmetics, so that the consumer can extract different types or colors of cosmetics with the applicator at the retail counter prior to sampling.

SUMMARY OF THE INVENTION

The present invention provides a cosmetic applicator comprising a body member made out of a porous material and having sufficient stiffness to withstand a pressure exerted by an user, wherein the user can extract an amount of cosmetic sufficient for a single use with the applicator. Preferably, in the case of lipsticks, the applicator has a generally cylindrical shape with at least one round or blunt end, or having a beveled surface at one end.

The applicator can also be hollow, wherein the cosmetic is deposited within the hollow applicator and is pushed through the top portion of the body member.

The present invention also provides methods for sampling cosmetic comprising the steps of (i) extracting an amount of cosmetic sufficient for a single use with a disposable porous applicator; and (ii) applying the cosmetic to the body of a consumer, wherein the cosmetic is extracted immediately prior to sampling the cosmetic.

Therefore, an object of the present invention is to provide a hygienic cosmetic applicator for consumer sampling.

Another object of the present invention is to provide a hygienic cosmetic applicator that carries an amount of cosmetic sufficient for a single use.

Another object of the present invention is to provide a disposable applicator that can be used by the consumer to extract cosmetic samples at the retail counter.

DETAILED DESCRIPTION OF THE PREFERRED EMBODIMENTS

The cosmetic applicator of the present invention can be used with a number of cosmetics, i.e., lipsticks, liquid makeups, eye shadows, lip balms, etc. For simplicity lipstick will be used when describing the present invention, but it will be noted that the present invention is not restricted to only lipstick.

Figure 1A:
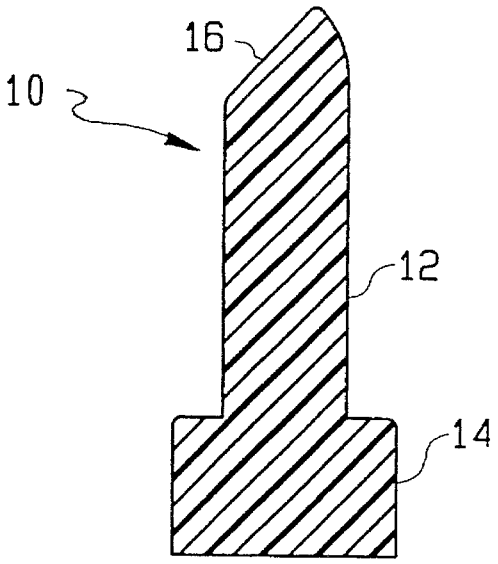
FIG. 1A is a cross-sectional view of a lipstick applicator according to the present invention.

Now referring to the Figures, wherein like numerals are used to designate like parts and according to FIG. 1, applicator 10 is depicted in FIG. 1A as having a shape that resembles that of a tube of lipstick. Applicator 10 is substantially rigid and is made out of porous polyethylene or other suitable materials that are capable of holding its shape. Applicator 10 should have sufficient stiffness to resist bending or other types of deformation when used by the consumer.

Figure 1B:
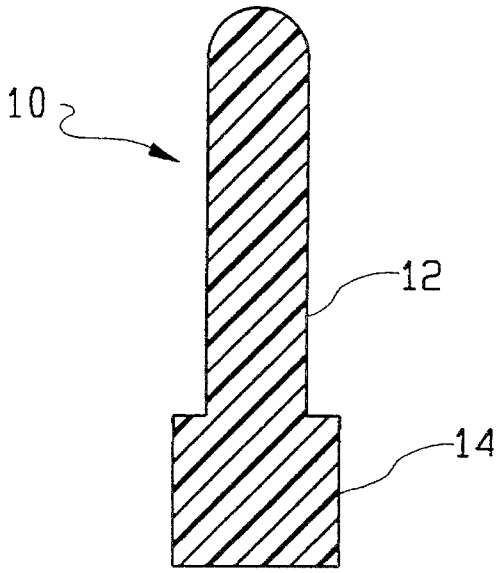
FIG. 1B is a cross-sectional view of an alternative embodiment of the lipstick applicator according to the present invention.

Applicator 10 comprises body portion 12 and base portion 14. Body portion 12 has a beveled surface 16. Beveled surface 16 is provided at the top of body portion 12 to facilitate the application of the lipstick stored on the applicator onto the lips. However, the top portion of bullet portion 12 may have other convenient shapes, e.g., round as shown in FIG. 1B or conical shape. It will be noted that surface 16 may also have either concave or convex curvature. Preferably, the tip of body portion 12 resembles the tip of a non-sample tube of lipstick.

The disposable applicator 10 of the present invention can be made with sintered polyethylene. In this process, granules of polyethylene are poured into a mold which has the desired lipstick tube shape. The granules are then compressed lightly and heat is added to bond the granules together to form solid applicator 10. It will be noted that in this process the granules are bonded but not melted. Applicator made with sintered polyethylene are porous having pores substantially the size of the polyethylene granules. Such pores are also interconnected in a way that lipstick would be able to flow from one pore to the next.

As stated above, it is desirable that the applicator can withstand the pressure exerted by the consumers during the extraction and application. The stiffness of the applicator is determined by the grain size of the polyethylene granules and the overall dimensions of the applicator. Thus, by varying the grain size and the dimensions of applicator 10, the desired stiffness as explained above can be achieved.

The grain size also controls the texture of applicator 10. The smaller the grain size the smoother the surface of applicator 10 would feel to the user. Smaller grain size can also aid in the product delivery. When grain size is small, the lipstick that are stored within the pores can be drawn out and be applied to the user due to capillary action.

Applicator 10 can be made out of other materials such as styrofoam and other processes such as extrusion, molding, die casting, etc. Thus, the example given above is only to illustrate, and not to limit, the present invention.

Figure 2:
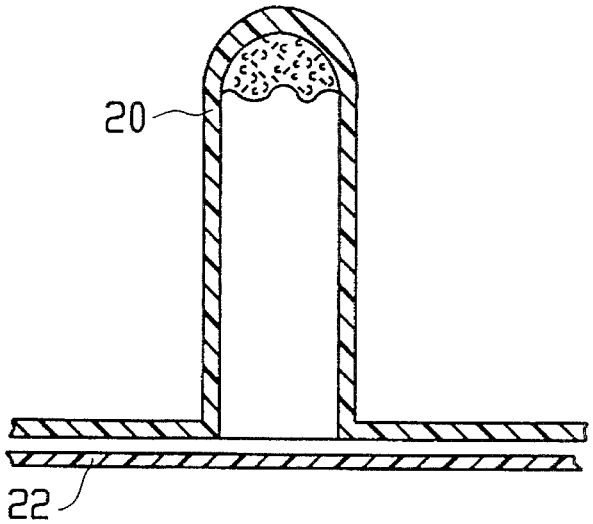
FIG. 2 is a cross-sectional view of a premeasured amount of lipstick in a disposable container.
Figure 3:
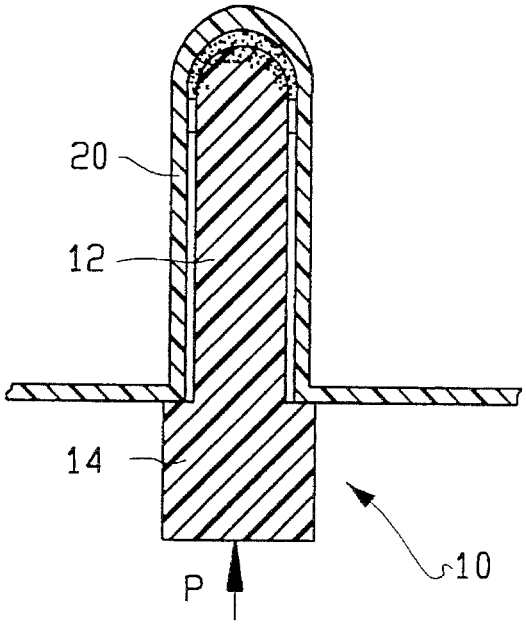
FIG. 3 is a cross-sectional view of the lipstick applicator of the present invention being used in conjunction with the disposable container shown in FIG. 2.

Applicator 10 may be used to extract a pre-measured amount of lipstick as shown in FIGS. 2 and 3. The lipstick is contained in capsule 20, where an amount of lipstick sufficient for one use is stored within. Capsule 20 is covered by lid 22, which is made out of a thin flexible material such as foil or plastics. Lid 22 is attached to capsule 20 by thermal methods or by adhesives. Capsule 20 can be manufactured on sheets or "blister" packs containing a large number of lipstick capsules. The individual capsule may be separated from each other by perforations for easy separation.

The lidding material may be peeled back or punctured to expose the lipstick and applicator 10 is inserted into capsule 20 to extract the lipstick. The consumer simply exerts a slight pressure on the lipstick. Such pressure forces some of the lipstick to enter the porous area and leaves a layer of lipstick on the surface of the applicator.

After the lipstick is transferred to the applicator, the consumer can apply the lipstick to her lips. Frictional contact between the applicator and the lips deposits a film or thin layer of lipstick on the lips. Further, due to the capillary action of the lipstick inside the pores, some of the lipstick stored in the pores of applicator 10 will also be applied to the lips. The used applicator may be discarded after one use.

Lipstick sampling in accordance with the present invention therefore provides an inexpensive, realistic and hygienic method of sampling lipsticks for the consumers. Blister packs of capsules 20 can be manufactured to contain many different shades, colors and textures of lipsticks. The consumer will be able to apply the lipsticks directly on her lips for sampling with the actual lipstick, and will not have to apply lipsticks to her hand and resort to her imagination with regard to appearance.

Figure 4:
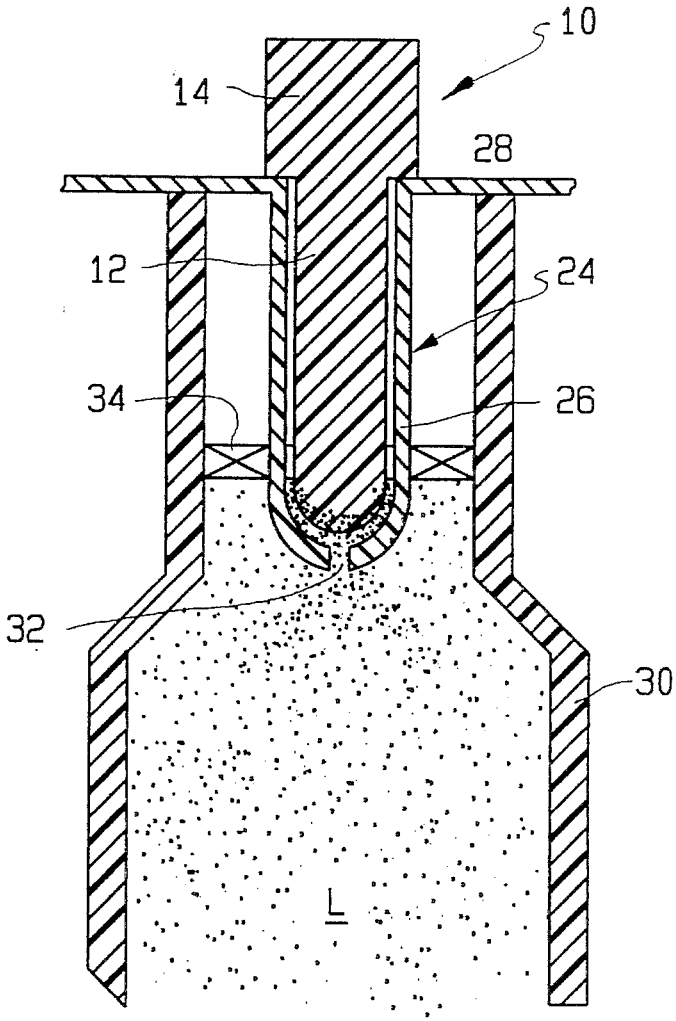
FIG. 4 is a cross-sectional view of the lipstick applicator of the present invention being used in conjunction with a permanent lipstick dispenser.

In another embodiment depicted in FIG. 4, applicator 10 can also be used in conjunction with bulk sources of lipsticks. As shown, a permanent well 24 having storage portion 26 and flat portion 28 is provided. Storage portion 26 is in communication with a bulk source of lipstick L contained within dispensing unit 30 through an aperture 32 defined at the bottom of storage portion 26. Well 24 is attached to dispensing unit 30 in such a way that when bulk source L is pressurized, lipstick will flow from bulk source L through aperture 32.

The amount of lipstick dispensed may be measured by several methods. For examples, it can be measured by applying a known pressure to bulk source L for a fixed time period. The pressure can be produced by a simple electrical motor driving a piston acting on dispensing unit 30, or the piston can be pushed by the consumer. The pressure can also be provided by a distensible bladder disposed inside bulk source L and connected to a source of compressed inert gas, such as air, nitrogen or carbon dioxide.

The lipstick can also be dispensed in premeasured volumes with devices such as calibration markings on dispensing unit 30 and a piston linearly advancing from one marking to the next. Lipstick can also be dispensed by a pusher rotationally and threadedly attached to a bottom of dispensing unit 30 such that by rotating the pusher one revolution a known volume of lipstick is released. The lipstick dispensed can be measured by the number of revolutions turned. The pusher may be rotated by hand or by an electrical motor.

Alternatively, the bulk source inside dispensing unit 30 may be contained in a disposable bag, and a pressure source as described above may be applied directly to the bag to dispense lipstick. An advantage of using the disposable bag is the relative ease in replacing the bulk lipstick once it is empty. The retailer can simply discard the empty bag and insert a new bag. For example, the disposable bag may be used in conjunction with the distensible bladder contained within the bag. As the distensible bladder is expanded within the bag, lipstick is dispensed. When the bladder has expanded to substantially the same size as the bag, most of the lipstick would have been dispensed.

Well 24 should be securely attached to dispensing unit 30. As shown in FIG. 4, flat portion 28 is shown to be connected to the walls of dispensing unit 30. Flat portion 28 may have threaded channel to receive a threaded top portion of the walls of dispensing unit 30. With the threaded connection, well 24 can easily be removed for cleaning or replacement. It is also desirable for the purpose of cleaning to minimize the outer area of well 24 that contacts lipstick. For this purpose there is provided a seal 34 disposed above but approximate aperture 32. This seal will prevent lipstick from bulk source L from advancing far beyond aperture 32. Thus, well 24 can be easily cleaned after it is removed from dispensing unit 30.

It will be noted that FIGS. 2–4 depict a well with a round nose applicator 10. However, well 24 and capsule 20 may also have shapes that would accommodate beveled surface 16 or the other shapes described above.

Figure 5A:
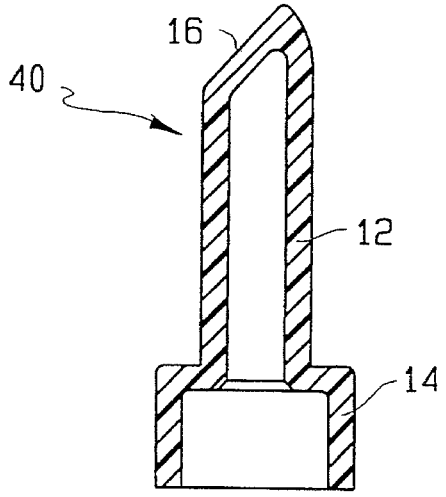
FIG. 5A is a cross-sectional view of a hollow lipstick applicator according to the present invention.
Figure 5B:
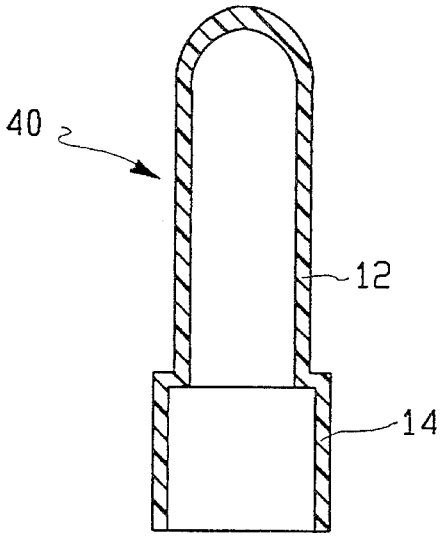
FIG. 5B is a cross-sectional view of another alternative embodiment of a hollow applicator according to the present invention.

So long as the applicator has sufficient stiffness to resist the force exerted by the consumer, it may have a hollow construction as shown in. FIGS. 5A and 5B. Hollow applicator 40 may be used with well 24 and capsule 20 as shown in FIGS. 2–4. Hollow applicator 40 can also be used in conjunction with another dispensing unit as shown in FIG. 6.

Figure 6:
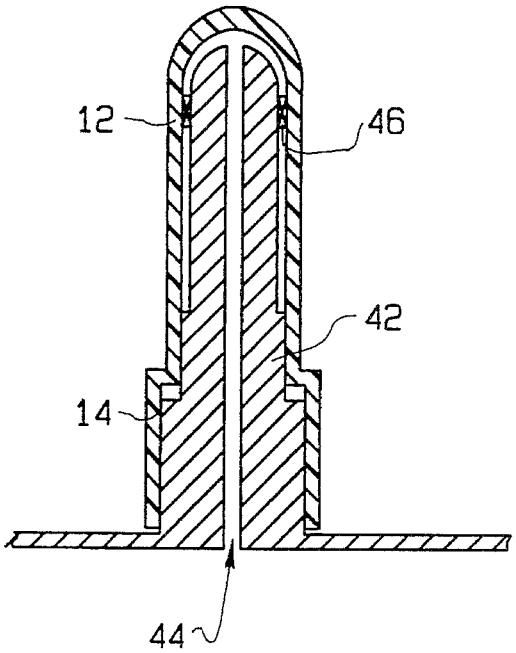
FIG. 6 is a cross-sectional view of a hollow applicator as shown in either FIGS. 5A and B being used with a further alternative embodiment of permanent lipstick dispenser.

In another alternative embodiment, an elongated member 42 with a channel 44 defined longitudinally therein is provided as shown in FIG. 6. Channel 44 is in communication with a bulk source of lipstick such that lipstick can be dispensed through channel 44 by pressure sources described above. When a consumer wishes to sample a particular shade or color of lipstick, she simply places hollow applicator 40 over the elongated member 42 so that hollow applicator 40 snugly covers elongated member 42 as shown in FIG. 6. A sealing member 46 is provided to keep the dispensed lipstick within the vicinity of the top of porous applicator 40.

The pressure applied to the bulk source will also drive the dispensed lipstick through the interconnected pores of the applicator to the top portion of hollow applicator 40. In this embodiment, when the lipstick reaches the outer surface of applicator 40, a sufficient amount of lipstick has been dispensed. Thus, the amount of lipstick dispensed can also be controlled by visual inspection.

While various embodiments of the present invention are described above, it is understood that various features of the preferred embodiments can be used singly or in any combination thereof. Thus the present invention will not be limited to only the specifically embodiments depicted herein.

What is claimed is:

1. A disposable cosmetic sampling applicator adapted for applying to a user in a manner simulating actual use of the cosmetic comprising:

a tip portion and an elongated body member, each made out of a porous material having a surface and pores sufficient to receive and transfer the cosmetic and having sufficient stiffness to withstand a pressure exerted by the user in application of the cosmetic, wherein the user can extract and transfer an amount of cosmetic from a sample supply sufficient for at least a single application with the applicator.

2. The cosmetic applicator according to claim 1 wherein the elongated body member has generally a cylindrical shape and wherein the tip portion is generally a round end.

3. The cosmetic applicator according to claim 1 wherein the elongated body member has generally cylindrical shape and wherein the tip portion has a beveled surface.

4. The cosmetic applicator according to claim 1 wherein the elongated body member is hollow.

5. The cosmetic applicator according to claim 4 wherein the pores are interconnected.

6. The cosmetic applicator according to claim 1 wherein the tip portion and the elongated body member is made out of sintered polyethylene.

7. The cosmetic applicator according to claim 1 wherein the cosmetic is lipstick.

8. The cosmetic applicator according to claim 1 wherein the applicator further comprises a base member.

9. The applicator according to claim 1, wherein the tip portion is formed integrally with the elongated body member.

10. A cosmetic sampling apparatus comprising:

a cosmetic sampling applicator having a tip portion and an elongated body member, each made out of a porous material having pores sufficient to receive and transfer the cosmetic and having sufficient stiffness to withstand a pressure exerted by the user in application of the cosmetic, and adapted for applying cosmetic to a user in a manner simulating actual use of the cosmetic; and a dispensing well in communication with a bulk source of cosmetic, wherein an amount of cosmetic sufficient for at least a single application in dispensed into the dispensing well when a pressure is applied to the bulk source;

wherein the user can extract and apply the dispensed cosmetic with the applicator.

11. The apparatus according to claim 10, wherein the tip portion of the applicator is formed integrally with the elongated body member.

12. A cosmetic sampling apparatus comprising:

a hollow porous cosmetic sampling applicator, which comprises a tip portion and an elongated portion having sufficient stiffness to withstand a force exerted by the user in application of the cosmetic, and adapted for applying cosmetic to a user in a manner simulating actual use of the cosmetic; and an injection member having a channel defined therein, said injection member is in communication with a bulk source of cosmetic, wherein an amount of cosmetic sufficient for at least a single application is dispensed through the channel when a pressure is applied to the bulk source;

wherein the pores in the hollow porous applicator are interconnected, and wherein said pressure also pushes the dispensed cosmetic through at least the tip portion of the applicator when the applicator is disposed over the injection member such that the user can apply the dispensed cosmetic with the applicator.

13. The apparatus according to claim 12, wherein the tip portion of the applicator is formed integrally with the elongated body member.

14. A method for sampling cosmetic comprising:

providing an amount of cosmetic sufficient for at least a single application;

extracting the amount of cosmetic with a disposable porous sampling applicator, which comprises a tip portion and an elongated body portion, having sufficient stiffness to withstand a force exerted by the user in application of the cosmetic, and adapted for applying cosmetic to a user in a manner simulating actual use of the cosmetic;

applying the cosmetic to the body of a consumer; and discarding the sampling applicator.

15. The method for sampling cosmetic according to claim 14 wherein the step of providing the cosmetic comprises extruding the amount sufficient for said single application from a bulk source into a receiving well.

16. The method for sampling cosmetic according to claim 14 wherein the cosmetic to be sampled is lipstick.

17. The method for sampling cosmetic according to claim 16 wherein the lipstick is extracted immediately prior to applying the lipstick.

18. A method for sampling cosmetic comprising:

depositing an amount of cosmetic sufficient for at least a single use inside a hollow disposable porous applicator, which comprises a tip portion and an elongated body portion, having sufficient stiffness to withstand a force exerted by the user in application of the cosmetic;

extruding the cosmetic through at least the tip portion of the applicator;

applying the cosmetic to the body of a consumer; and discarding the applicator.

19. The method for sampling cosmetic according to claim 18, wherein the cosmetic is pushed through at least the tip portion of the applicator until it is extruded to the outer surface of the wall of the applicator.

20. The method for sampling cosmetic according to claim 19 wherein the cosmetic is deposited and extruded immediately prior to applying the cosmetic.

21. The method for sampling cosmetic according to claim 18 wherein the cosmetic to be sampled is lipstick.

22. A cosmetic sample applicator adapted to simulate an actual, non-sample applicator to apply a cosmetic sample to a user in a manner simulating actual use of the cosmetic, said sample applicator comprising a porous active applicator portion and a porous elongated body member and having a shape substantially matching at least a portion of said non-sample applicator, wherein the applicator has a substantially smooth surface, said surface and pores are adapted to adhere and transport an amount of cosmetic approximately equal to one application from a cosmetic source to the user.

23. The applicator according to claim 22, wherein the non-sample applicator is a lipstick and the active applicator portion comprises a tip of the lipstick.

24. The applicator according to claim 22, wherein said body member surface has sufficient strength and stiffness to remain substantially undeformed by force exerted by the user in applying the cosmetic sample.

* * * * *